US011359318B2

(12) United States Patent
Lee et al.

(10) Patent No.: US 11,359,318 B2
(45) Date of Patent: Jun. 14, 2022

(54) METHOD FOR CONTROLLING WASHING MACHINE

(71) Applicant: LG ELECTRONICS INC., Seoul (KR)

(72) Inventors: Sangjun Lee, Seoul (KR); Youngjong Kim, Seoul (KR); Hyungkwan Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 122 days.

(21) Appl. No.: 16/340,021

(22) PCT Filed: Oct. 5, 2017

(86) PCT No.: PCT/KR2017/011105

§ 371 (c)(1),
(2) Date: Apr. 5, 2019

(87) PCT Pub. No.: WO2018/066972

PCT Pub. Date: Apr. 12, 2018

(65) Prior Publication Data

US 2020/0040506 A1 Feb. 6, 2020

(30) Foreign Application Priority Data

Oct. 5, 2016 (KR) ..... 10-2016-0128552

(51) Int. Cl.
*D06F 33/34* (2020.01)
*D06F 39/02* (2006.01)
(Continued)

(52) U.S. Cl.
CPC ..... *D06F 33/34* (2020.02); *D06F 37/40* (2013.01); *D06F 39/02* (2013.01); *D06F 39/088* (2013.01);
(Continued)

(58) Field of Classification Search
CPC .... D06F 33/00; D06F 33/30–76; D06F 37/36; D06F 37/40; D06F 35/005–006; D06F 39/08–088; D06F 39/028
See application file for complete search history.

(56) References Cited

U.S. PATENT DOCUMENTS 5,671,493 A * 9/1997 Moon ..... D06F 34/18 8/159
2006/0080787 A1* 4/2006 Choi ..... D06F 33/34 8/148
(Continued)

FOREIGN PATENT DOCUMENTS

CN 1954114 A 4/2007
CN 101397743 A * 4/2009
(Continued)

*Primary Examiner* — Michael E Barr
*Assistant Examiner* — Omair Chaudhri
(74) *Attorney, Agent, or Firm* — Dentons US LLP

(57) ABSTRACT

The present invention relates to a method of controlling a washing machine comprising an outer tub containing water, an inner tub which accommodates laundry and is rotatably installed in the outer tub, a dispenser which supplies detergent into the inner tub, and a spray nozzle for spraying water into the inner tub, including the steps of: (a) supplying water into the inner tub via the dispenser; (b) supplying water into the inner tub through the spray nozzle, during when water is supplied into the inner tub via the dispenser; and (c) rotating the inner tub at a cloth wetting speed at which at least some of the laundry in the inner tub is adhered to an inner surface of the inner tub and can be rotated integrally with the inner tub, during when water is supplied through the spray nozzle.

12 Claims, 7 Drawing Sheets

(51) Int. Cl.

| | |
|---|---|
| ***D06F 39/08*** | (2006.01) |
| ***D06F 103/04*** | (2020.01) |
| ***D06F 103/18*** | (2020.01) |
| ***D06F 105/02*** | (2020.01) |
| ***D06F 105/04*** | (2020.01) |
| ***D06F 105/46*** | (2020.01) |
| ***D06F 105/48*** | (2020.01) |
| ***D06F 37/40*** | (2006.01) |
| *D06F 103/30* | (2020.01) |
| *D06F 105/58* | (2020.01) |
| *D06F 101/20* | (2020.01) |

(52) U.S. Cl.
CPC ..... *D06F 2101/20* (2020.02); *D06F 2103/04* (2020.02); *D06F 2103/18* (2020.02); *D06F 2103/30* (2020.02); *D06F 2105/02* (2020.02); *D06F 2105/04* (2020.02); *D06F 2105/46* (2020.02); *D06F 2105/48* (2020.02); *D06F 2105/58* (2020.02)

(56) References Cited

U.S. PATENT DOCUMENTS

2010/0000573 A1* 1/2010 Hendrickson ..... D06F 33/37 134/18
2010/0325815 A1* 12/2010 Im ..... D06F 33/34 8/159
2011/0005339 A1* 1/2011 Ashrafzadeh ..... D06F 33/36 73/862.192
2011/0099732 A1* 5/2011 Im ..... D06F 37/306 8/137
2012/0159717 A1* 6/2012 Jang ..... D06F 35/006 8/137
2012/0180534 A1* 7/2012 Cho ..... D06F 35/006 68/18 R
2014/0033449 A1* 2/2014 Im ..... D06F 37/266 8/137
2017/0159223 A1* 6/2017 Alexander ..... D06F 39/083
2018/0087198 A1* 3/2018 Kim ..... D06F 37/304

FOREIGN PATENT DOCUMENTS

| | | | | |
|---|---|---|---|---|
| CN | 101397743 | A | | 4/2009 |
| CN | 101935931 | A | | 1/2011 |
| CN | 102080323 | A | | 6/2011 |
| CN | 202007336 | U | | 10/2011 |
| CN | 101812788 | B | | 2/2013 |
| JP | 2010046349 | A | | 3/2010 |
| JP | 4555327 | B2 | | 9/2010 |
| KR | 20010077292 | A | * | 8/2001 |
| KR | 200336362 | Y1 | | 12/2003 |
| KR | 1020110053080 | A | | 5/2011 |
| KR | 1020130085200 | A | | 7/2013 |
| KR | 1020130125199 | A | | 11/2013 |
| KR | 1020160049366 | A | | 5/2016 |

* cited by examiner

FIG. 5

| STEP | CLOTH AMOUNT DETECTING(S1) | COLD WATER SUPPLY (S2) | COLD/HOT WATER SUPPLY(S3) | CLOTH WETTING(S4) | WET CLOTH AMOUNT DETECTING(S5) | WATER SUPPLY(S6) | WASHING(S7) |
|---|---|---|---|---|---|---|---|
| RPM | Vd | 30 | | 30-100 | Vw | 30-100 | |
| FIRST COLD WATER VALVE (121) | OFF | | ON | | OFF | ON | OFF |
| HOT WATER VALVE (124) | | OFF | ON | | | OFF | |
| THIRD COLD WATER VALVE (123) | | OFF | | ON | OFF | ON | OFF |

FIG. 7

| STEP | CLOTH AMOUNT DETECTING(S1) | COLD WATER SUPPLY (S2) | CLOTH WETTING(S4) | WET CLOTH AMOUNT DETECTING(S5) | WATER SUPPLY(S6) | WASHING(S7) |
|---|---|---|---|---|---|---|
| RPM | Vd | 30 | 30-100 | Vw | 30-100 | |
| FIRST COLD WATER VALVE (121) | OFF | ON | | OFF | ON | OFF |
| HOT WATER VALVE (124) | OFF | | | | | |
| THIRD COLD WATER VALVE (123) | OFF | | | OFF | ON | OFF |

METHOD FOR CONTROLLING WASHING MACHINE

This application is a National Stage Application of International Application No. PCT/KR2017/011105, filed on Oct. 5, 2017, which claims the benefit of Korean Patent Application No. 10-2016-0128552, filed on Oct. 5, 2016, all of which are hereby incorporated by reference in their entirety for all purposes as if fully set forth herein.

TECHNICAL FIELD

The present invention relates to a control method of washing machine.

BACKGROUND ART

Generally, a washing machine is an apparatus that processes laundry through various operations such as washing, dewatering and/or drying. The washing machine includes an outer tub containing water and an inner tub rotatably provided in the outer tub, and the inner tub is provided with a plurality of through holes through which water passes.

When a user selects a desired course by using a control panel in a state in which laundry (hereinafter, also referred to as "cloth") such as clothes or bedding is put in the inner tub, a preset algorithm corresponding to the selected course is executed, thereby performing washing, rinsing, dewatering, and the like.

An ordinary washing machine processes a laundry by sequentially performing a series of operations of a washing operation, a rinse operation, and a dewatering operation. Such a washing machine is provided with a dispenser for selectively supplying a laundry detergent, a rinsing agent, a bleach, etc. along with water depending on a progressing operation.

Typically, before performing a washing operation, the washing machine performs a process of supplying detergent together with water, and then rotating the inner tub so that the detergent is evenly dissolved in the water. However, conventionally, after the detergent is supplied together with water through the dispenser and the outer tub is filled up to a preset water level, the water supply is terminated, the inner tub is rotated to dissolve the detergent, and then the washing operation is performed according to a set algorithm. This method has a problem that it takes a long time to enter the washing operation, because the water supply and the detergent dissolving are accomplished at a different time.

DISCLOSURE

Technical Problem

A problem to be solved by the present invention is to provide a control method of a washing machine which can uniformly dissolve the detergent in a water supply process.

In addition, the present invention further provides a control method of a washing machine can reduce overall washing time in comparison with the conventional method.

In addition, the present invention further provides a control method of a washing machine which can provide the same washing performance or the improved washing performance in comparison with the conventional method as well as reduce the washing time.

Technical Solution

The present invention relates to a method of controlling a washing machine comprising an outer tub containing water, an inner tub which accommodates laundry and is rotatably installed in the outer tub, a dispenser which supplies detergent into the inner tub, and a spray nozzle for spraying water into the inner tub.

The method supplies water into the inner tub via the dispenser, and supplies water into the inner tub through the spray nozzle, during when water is supplied into the inner tub via the dispenser.

In addition, the method rotates the inner tub at a cloth wetting speed at which at least some of the laundry in the inner tub is adhered to an inner surface of the inner tub and can be rotated integrally with the inner tub, during when water is supplied through the spray nozzle.

Advantageous Effects

The control method of the washing machine of the present invention can dissolve the detergent evenly in the water supply process, thereby reducing the entire washing time in comparison with the conventional method.

In addition, it is possible to provide the same washing performance or the improved washing performance in comparison with the conventional method while reducing the washing time.

DESCRIPTION OF DRAWINGS

FIG. 5 is a table showing steps according to a control method of an embodiment of the present invention.

FIG. 7 is a table showing steps according to a control method of another embodiment of the present invention.

MODE FOR INVENTION

Figure 1:
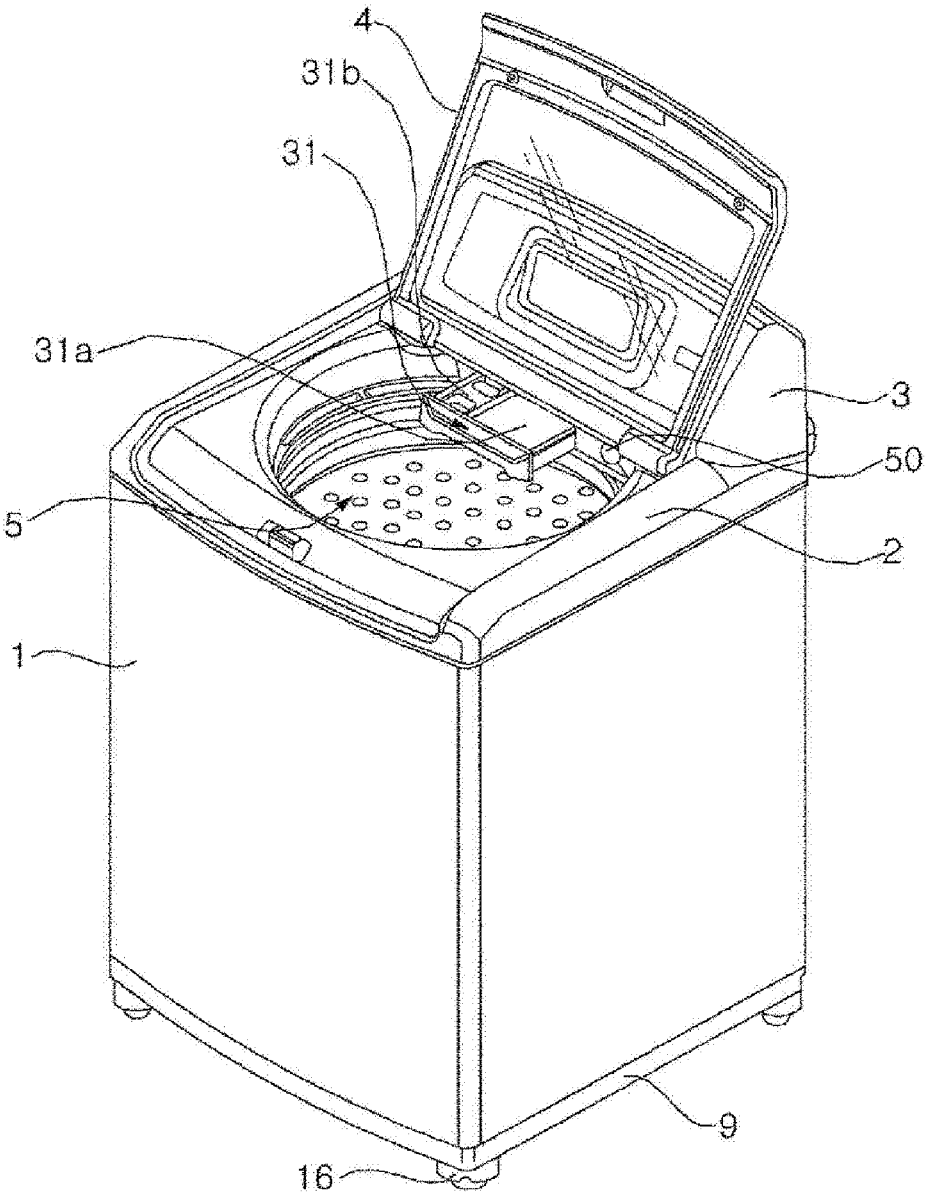
FIG. 1 is a perspective view of a washing machine according to an embodiment of the present invention.

Hereinafter, preferred embodiments of the present invention will be described with reference to the accompanying drawings. In describing the present embodiment, the same designations and the same reference numerals are used for the same components, and further description thereof will be omitted.

Figure 2:
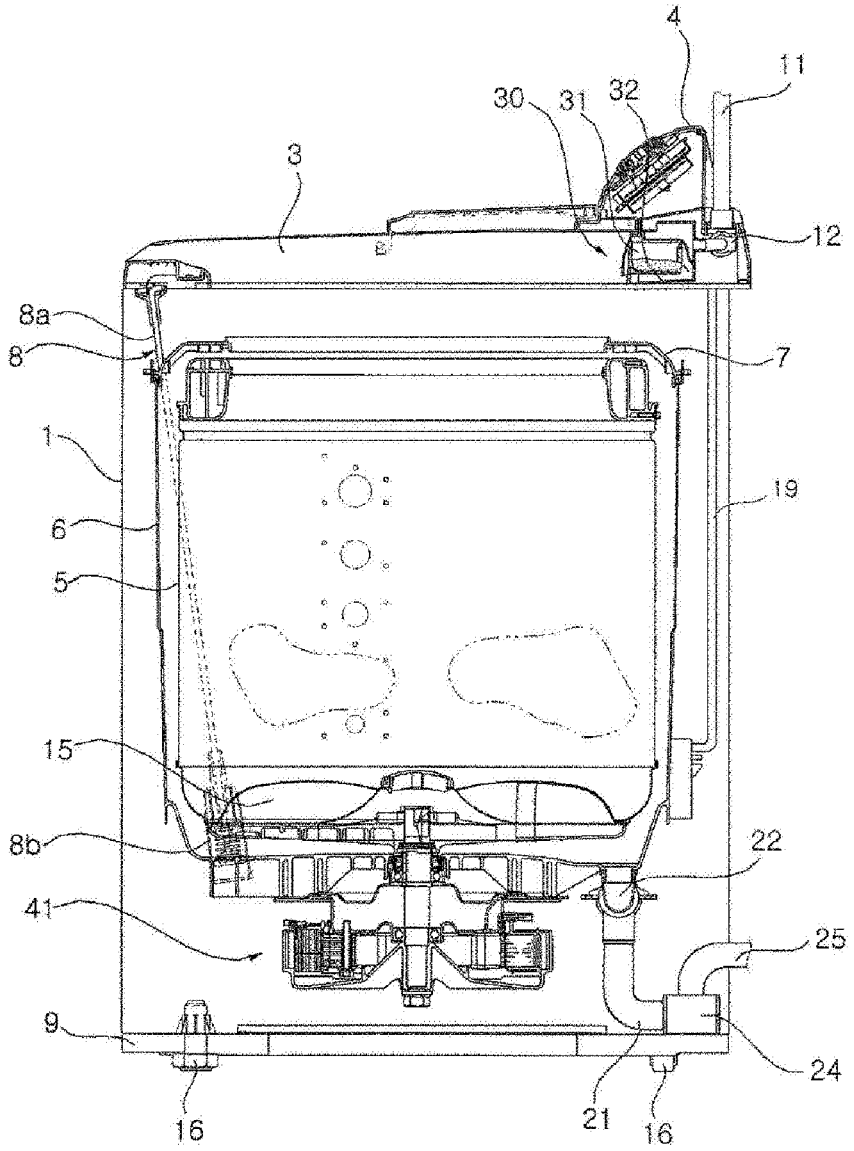
FIG. 2 is a side sectional view of the washing machine shown in FIG. 1.
Figure 3:
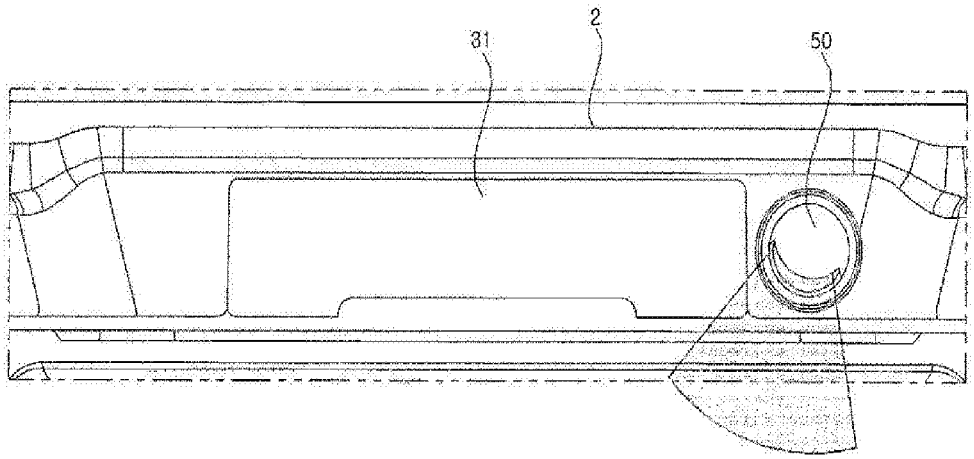
FIG. 3 is a partial view of a top cover shown in FIG. 1.
Figure 4:
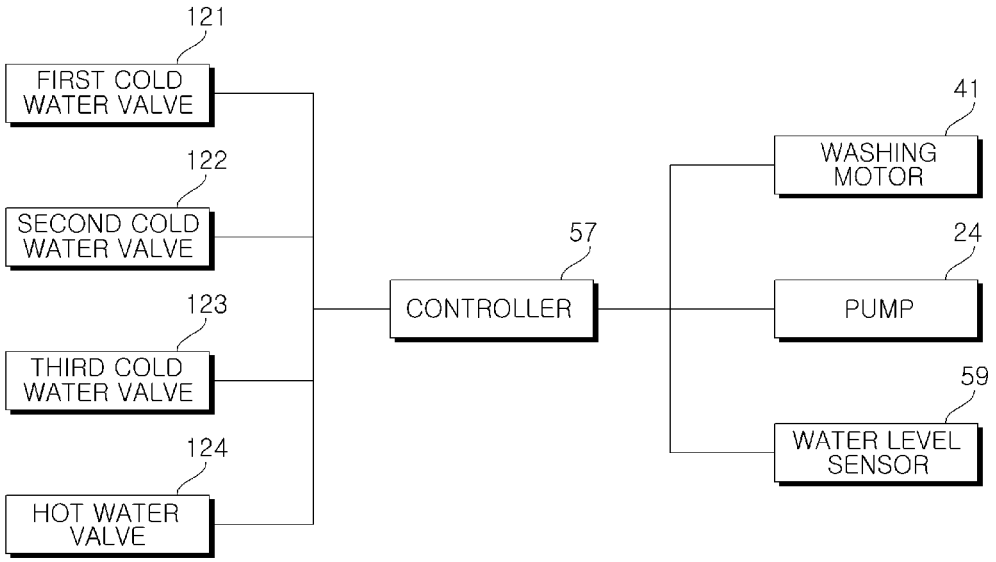
FIG. 4 is a block diagram showing a control relationship between main parts of a washing machine according to an embodiment of the present invention.

FIG. 1 is a perspective view of a washing machine according to an embodiment of the present invention. FIG. 2 is a side sectional view of the washing machine shown in FIG. 1. FIG. 3 is a partial view of a top cover shown in FIG. 1. FIG. 4 is a block diagram showing a control relationship between main parts of a washing machine according to an embodiment of the present invention.

Referring to FIGS. 1 to 4, a washing machine according to an embodiment of the present invention may include a cabinet 1, a top cover 2, a lid 4, a base 9, and a control panel 3.

The cabinet 1 may be supported by the base 9, and may include a front surface, both side surfaces, and a rear surface which are installed along the outer edge of the base 9 so as to form a space for accommodating the outer tub 6 inwardly.

The base 9 is formed in a flat shape corresponding to the floor where the washing machine is provided, and may be supported by four supporting legs 16 provided near four corners of the cabinet 1.

The top cover 2 may be coupled to the upper end of the cabinet 1. The top cover 2 may be provided with a loading port for loading and unloading the laundry (or "cloth"), and the lead 4 for opening and closing the loading port may be rotatably coupled to the top cover 2.

In the cabinet 1, an outer tub 6 for storing water may be disposed. The outer tub 6 may be provided in a form of hanging in the cabinet 1 by a hanger 8. The hanger 8 may include a support rod 8*a* whose upper end is pivotably coupled with the top cover 2, and a suspension 8*b* which is installed in the support rod 8*a* to buffer the vibration of the outer tub 6. Such a suspension 8*b* may be configured in various forms. For example, the suspension 8*b* may include an outer tub support member which supports the outer tub 5 and is moved along the support rod 8*a* as the outer tub 6 vibrates, and a spring which is fixed to the lower end of the support rod 8*a* and resiliently supports the outer tub support member. The hanger 8 may be provided at four corners of the cabinet 1, respectively.

The upper side of the outer tub 6 may be open, and an outer tub cover 7 may be provided in the opened upper side. The outer tub cover 7 may be formed in a ring shape having an open central portion for the loading/unloading of laundry.

In the outer tub 6, an inner tub 5 that accommodates the laundry and is rotated about a vertical axis may be disposed. The inner tub 5 may be formed with a plurality of holes through which water can pass, and water can be exchanged between the inner tub 5 and the outer tub 6 through the hole.

A drainage bellows 21 for draining water from the outer tub 6 and a drainage valve 22 for interrupting the drainage bellows 21 may be provided. The drainage bellows 21 is connected to a pump 24, and water may be supplied to the pump 24 through the drainage bellows 21 when the drainage valve 22 is opened. Hereinafter, although not specifically described, it should be understood that the pump 24 is operated in a state in which the drainage bellows 21 is open.

A pulsator 15 may be rotatably provided in the inner lower portion of the inner tub 5. The pulsator 15 may include a plurality of upwardly projected radial ribs. When pulsator 15 is rotated, water stream may be formed by the ribs.

A washing motor 41 may be disposed in the cabinet 1 to provide power for rotating the inner tub 5 and the pulsator 15. The washing motor 41 may be provided below the outer tub 6 and may be provided in the form of hanging in the cabinet 1 together with the outer tub 6. A rotary shaft of the washing motor 41 is always coupled with the pulsator 15 and may be coupled with or discoupled from the inner tub 5 depending on the switching operation of a clutch (not shown). Therefore, when the washing motor 41 is operated in a state where the rotary shaft is coupled with the inner tub 5, the pulsator 15 and the inner tub 5 are integrally rotated. When the rotary shaft is separated from the inner tub 5, only the pulsator 15 is rotated in the state where the inner tub 5 is stopped.

A transmission (not shown) that shifts the speed (or the number of revolutions) of the washing motor 41 and transfers the shifted speed to the pulsator 15 may be further provided. In a state in which the inner tub 5 is separated from the rotary shaft of the washing motor 41 by the clutch (i.e., in a state in which only the pulsator 15 is rotated), the pulsator 15 may be rotated at a speed reduced by the transmission at a preset deceleration ratio n. When the rotational speed of the washing motor 41 is n, the pulsator 15 is rotated at a speed of 1, and "n" at this time is defined as a deceleration ratio. Hereinafter, the deceleration ratio n is 3, but it is not limited thereto.

A brushless direct current motor (BLDC motor), which is capable of controlling a speed and widely applicable to a conventional washing machine, is suitable for the washing motor 41, but is not necessarily limited thereto. As a method of controlling the speed of the BLDC motor, various methods including a vector control method of the input current of motor by feedback of the output of motor by using a proportional-integral controller (PI controller), a proportional-integral-derivative controller (PID controller), and the like are already well known. Thus, the speed control of the washing motor 41 may be achieved by the type of the motor and a corresponding known method. Therefore, a detailed description thereof will be omitted.

The top cover 2 may be provided with a dispenser 30 for supplying an additive acting on laundry to the inner tub 5 together with water. The additive supplied by the dispenser 30 may be a detergent and a fabric softener.

A pump 24 for draining water contained in the outer tub 6 may be provided.

The pump 24 is connected to the drainage bellows 21 for discharging water from the outer tub 6. The water pumped by the pump 24 is discharged to the outside through the drainage hose 25.

The dispenser 30 may include a dispenser housing 32 disposed inside the top cover 2 and a drawer 31 which contains the additive and is drawably accommodated in the dispenser housing 32. The top cover 2 may be provided with a draw opening for allowing the drawer 31 to pass therethrough, and the dispenser housing 32 may have an opening formed on one surface thereof facing the draw opening in correspondence with the draw opening.

The drawer 31 may be divided into a detergent accommodating portion 31*a* for accommodating the detergent for washing and a rinsing agent accommodating portion 31*b* for accommodating the rinsing agent. The detergent accommodating portion 31*a* and the rinsing agent accommodating portion 31*b* are divided into structures such as rib, partition, and the like. Thus, when water is supplied to the detergent accommodating portion 31*a*, only detergent is supplied into the inner tub 5 together with the water. On the other hand, when the water is supplied to the rinsing agent accommodating portion 31*b*, only the rinsing agent is supplied into the inner tub 5 together with water.

The washing machine may include a spray nozzle 50 for spraying water into the inner tub 5. The spray nozzle 50 may be installed in the top cover 2, and is preferably disposed beside the drawer 31.

The washing machine may include at least one water supply hose 11 for guiding water supplied from an external water source such as a faucet. The at least one water supply hose 11 may include a cold water hose (not shown) for receiving cold water from the external water source and a hot water hose (not shown) for receiving hot water.

A valve assembly 12 for interrupting the water supplied through the at least one water supply hose 11 may be provided. The valve assembly 12 may include at least one water supply valve 121, 122, 123, 124.

The hot water supplied through the hot water hose may be supplied into the inner tub 5 via the dispenser 30. At this time, the hot water passes through the detergent accommodating portion 31*a* of the drawer 31. A hot water flow path (not shown) for guiding the water supplied through the hot water hose to the detergent accommodating portion 31*a* may be provided, and the valve assembly 12 may include a hot water valve 124 for interrupting the hot water flow path under the control of a controller 57.

The cold water supplied through the cold water hose may be selectively supplied to the dispenser 30 or the spray nozzle 50. At this time, the cold water supplied to the dispenser 30 may be supplied again into the inner tub 5, after selectively passing the detergent accommodating portion 31*a* or the rinsing agent accommodating portion 31*b* of the drawer 31.

A first cold water flow path (not shown) for guiding the water supplied through the cold water hose to the detergent accommodating portion 31*a*, and a second cold water flow path (not shown) for guiding the water to the rinsing agent accommodating portion 31*b* may be provided. The valve assembly 12 may include a first cold water valve 121 for interrupting the first cold water flow path and a second cold water valve 122 for interrupting the second cold water flow path. The first cold water valve 121 and the second cold water valve 122 may be operated under the control of the controller 57.

A third cold water flow path (not shown) for guiding the cold water supplied through the cold water hose to the spray nozzle 50 may be provided. The valve assembly 12 may include a third valve 123 for interrupting the third cold water flow path under the control of the controller 57.

The control panel 3 may include an input means such as a key, a button, a touch panel, and the like capable of setting, selecting, and adjusting various operation modes provided by the washing machine, and a display panel such as a lamp, an LCD panel, an LED panel, and the like for displaying various information such as a operating state of the washing machine, a response, a warning, a notification, and the like according to the selection of the operation mode may be provided.

A water level sensor 59 detects the water level in the outer tub 6. A communicating pipe 19 elongated vertically is communicated with the outer tub 6. The water level sensor 59 detects the air pressure in the communicating pipe 19 which varies according to the water level in the outer tub 6 and outputs a frequency signal. The controller 57 may determine the water level according to the frequency signal. However, the present invention is not limited thereto, and the water level sensor 59 may be implemented in other well-known methods.

Figure 6:
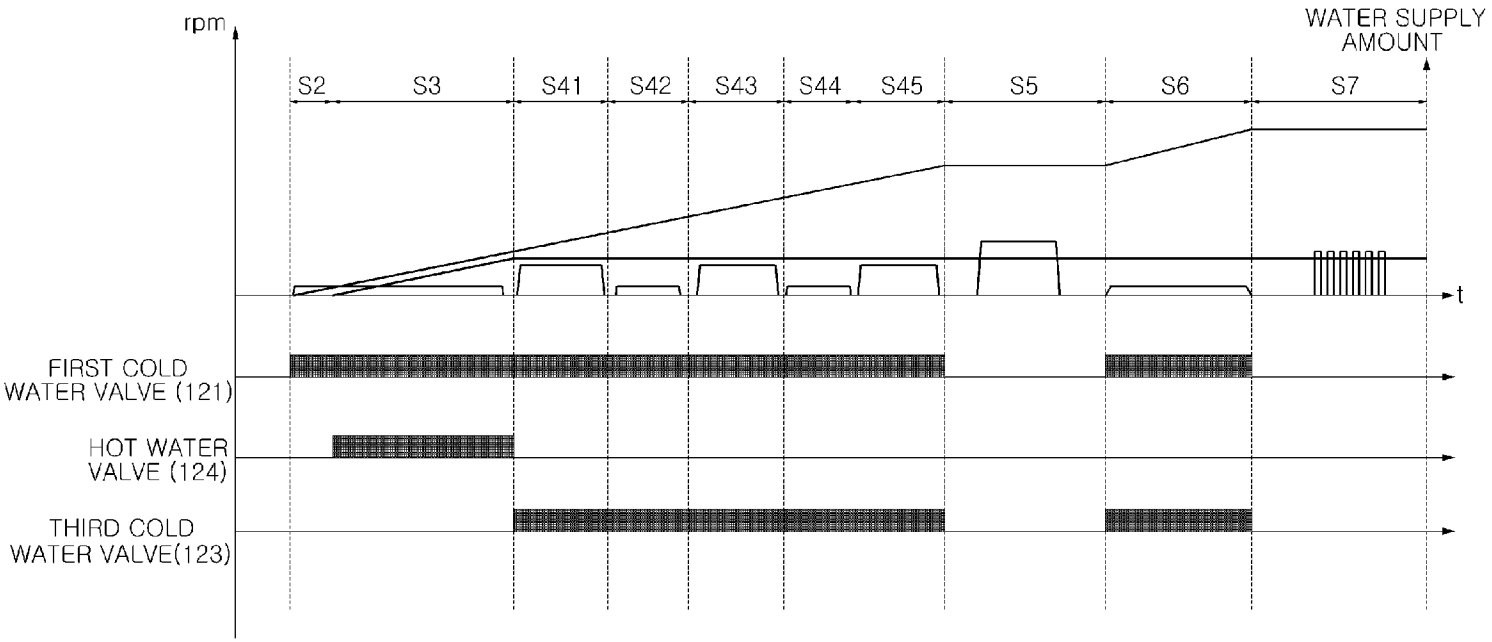
FIG. 6 is a graph showing the operation control of main configurations according to the control method of FIG. 5.

FIG. 5 is a table showing steps according to a control method of an embodiment of the present invention. FIG. 6 is a graph showing the operation control of main configurations according to the control method of FIG. 5.

Hereinafter, it is exemplified that the inner tub 5 is rotated at the same speed as the washing motor 41, and the speed ratio of the inner tub 5 and the pulsator 15 is 3:1.

The left vertical axis (rpm axis) of the graph shown in the drawing indicates the rotational speed of the washing motor 41, and the right vertical axis (water amount axis) indicates the amount (water amount) of water supplied into the outer tub 6. In addition, in the graph, a section in which the first cold water valve 121, the third cold water valve 123, and the hot water valve 124 are operated is indicated as a block, the cold water change is indicated as (a), and the hot water change is indicated as (b).

Referring to FIG. 5 and FIG. 6, a method of controlling a washing machine according to an embodiment of the present invention may include a step (S2, S3, S4) of supplying water and detergent into the inner tub 5 by supplying water through the dispenser 30, a step (S4) (the third cold water valve 123 ON) of supplying water into the inner tub 5 through the spray nozzle 50 during the supply of the water, and a step (S41, S43, S45) of rotating the inner tub 5 at a speed V2 (hereinafter, it is also referred to as "cloth wetting speed) at which at least some of the laundry in the inner tub 5 is adhered to the inner surface of the inner tub 5 and can be rotated integrally with the inner tub 5, while water is being supplied through the spray nozzle 50.

More specifically, the method of controlling a washing machine according to an embodiment of the present invention may include steps S1 to S7.

Step S1 (first cloth amount detecting step) is a step of detecting the amount of laundry (hereinafter, referred to as "cloth amount") loaded into the inner tub 5 before the supply of water is performed. In this case, generally, the laundry (hereinafter referred to as "dry cloth") that is not wetted with water is detected. The washing motor 41 may be rotated at a preset dry cloth amount detecting speed Vd, and at this time, the pulsator 15 may be rotated. Since the load applied to the washing motor 41 varies depending on the cloth amount, the output current of the washing motor 41 varies, and the controller 57 may determine the cloth amount based on the output current. However, the present invention is not limited thereto, and in step S1, the cloth amount may be detected by various known methods.

In step S2 (cold water supply step), cold water may be supplied into the inner tub 5 through the dispenser 30. The cold water is supplied to the detergent accommodating portion 31*a* of the drawer 31 as the first cold water valve 121 is opened. The detergent contained in the detergent accommodating portion 31*a* is introduced into the inner tub 5 together with the cold water. In the embodiment, the cold water supply time is set to 3 seconds, but it is not necessarily limited thereto.

While the cold water is being supplied in step S2, the inner tub 5 may be rotated at the first speed V1 (hereinafter also referred to as "cloth dispersion speed"). The first speed V1 is determined within a range in which at least some of the cloth can be shifted in the inner tub 5. As the rotational speed of the inner tub 5 is increased, the centrifugal force is increased and the laundry is adhered to the inner surface of the inner tub 5. At this time, since the cloth is rotated integrally with the inner tub 5, the position with respect to the inner tub 5 is fixed. The magnitude of the centrifugal force applied to the cloth depends not only on the rotational speed of the inner tub 5 but also on the position of the cloth in the inner tub 5. For example, in the case of a small amount of cloth introduced into the inner tub 5, and in the case of a large amount of cloth, supposing that the inner tub 5 is rotated at the same speed, a full amount of cloth may be adhered to the inner surface of the inner tub 5 in the case of a small amount. However, in the case of a large amount, the shift of the cloths is limited due to the interference between the cloths. Thus, the cloths close to the rotation center of the inner tub 5 can not receive sufficient centrifugal force, so that the cloths can not be integrally rotated in a state where the position with respect to the inner tub 5 is fixed. Therefore, it is preferable that the rotational speed of the inner tub 5, which permits the shift of at least some of the cloths in the inner tub 5, is determined differently depending on the amount of cloth. The first speed V1 may be set according to the cloth amount detected in the first cloth amount detecting step S1. That is, the first speed V1 may be set to have a larger value, when the detected cloth amount is large (or when the cloth amount is divided into several sections and the section to which the detected cloth amount belongs is large). The first speed V1 may be set between 30 rpm and 120 rpm.

In step S3 (cold/hot water supply step), cold water and hot water may be supplied into the inner tub 5 through the dispenser 30. The opening of the first cold water valve 121 in the step S2 is maintained in the step S3, and the hot water valve 124 may be further opened.

When the water level detected by the water level sensor 59 reaches a preset water level (hereinafter referred to as "cloth wetting water level"), the controller 57 may block the hot water valve 124. However, the present invention is not limited thereto, and the controller 57 can block the hot water valve 124 when the time during which the hot water valve 124 is opened reaches a preset time.

During the water supply in the step S3, the inner tub 5 may be rotated at the first speed V1. Preferably, the rotation of the inner tub 5 in the step S2 is continued even when reaching the step S3.

In step S4 (cloth wetting step), the hot water valve 124 is blocked and the first cold water valve 121 is kept open. In the step S4, the inner tub 5 may be rotated at the second speed V2 (hereinafter, referred to as "cloth wetting speed"). The dissolving or diluting action of the detergent supplied through the dispenser 30 in steps S2 and S3 is promoted in the step S4. In the step S4, the water supply through the spray nozzle 50 may be performed simultaneously.

More specifically, the step S4 may include a step S41 of rotating the inner tub 5 at the second speed V2 and supplying (or spraying) water through the spray nozzle 50, and may be performed repeatedly as in the embodiment.

(S41(1), S41(2), S41(3))

In addition, the step S4 may include a step S42 of rotating the inner tub 5 at the first speed V1 (e.g., 30 rpm), and supplying water through the spray nozzle 50.

Steps S41 and S42 may be repeated alternately. In the step S41, the inner tub 5 is rotated at a speed V2 at which at least some (preferably, all) of the laundry is adhered to the inner surface of the inner tub 5 and can be rotated integrally with the inner tub 5. The speed V2 may vary depending on the cloth amount, but is set in a considerably high range from 80 to 120 rpm. In the embodiment, it is 100 rpm but not limited thereto.

In such a speed range, a water stream of detergent dissolved water (hereinafter, referred to as "detergent water") which permeates the laundry adhered to the inner surface of the inner tub is formed. When the water level is sufficient, the detergent water may rise along between the outer tub 6 and the inner tub 5, and then may overpass the upper end of the inner tub 5 to be poured into the inner tub 5. That is, in the step S4, since foam due to the detergent may easily occur, the occurrence of the foam can be suppressed, by decelerating the inner tub 5 to the first speed V1 and rotating the inner tub 5 again at the second speed V2, not continuously rotating the inner tub 5 at the second speed V2.

In the step S4, the water supply through the spray nozzle 50 may be performed for a preset time (hereinafter referred to as "cloth wetting spraying time"). The controller 57 may block the third cold water valve 123, when the cloth wetting spraying time is elapsed, after the third cold water valve 123 is opened.

While the step S4 is performed, the water level sensor 59 may detect the water level. When the water level detected by the water level sensor 59 reaches a preset water level (hereinafter referred to as "cloth wetting completion water level"), the first water level valve 121 may be blocked.

In the step S4, preferably, the third cold water valve 123 is first blocked before the water level in the outer tub 6 reaches the cloth wetting completion water level, and then, when the water level reaches the cloth wetting completion water level, the first cold water valve 121 is blocked.

After the step S4 is completed, step S5 may be performed. In the step S5, the inner tub 5 may be rotated at a preset wet cloth amount detection speed Vw in the state in which the water supply is stopped. The wet cloth amount detection speed Vw may be set to a value larger than the second speed V2. The controller 57 may determine the wet cloth amount based on the current output from the washing motor 41, while the inner tub 5 is rotated at the wet cloth amount detection speed Vw. However, the present invention is not limited thereto, and it is obvious that the wet cloth amount may be obtained by other known methods.

In a top-load type washing machine like the embodiment, it is possible to additionally load laundry while the washing machine is being operated. In this case, the dry cloth amount obtained in the step S1 does not reflect the final cloth amount. Accordingly, in step S5, the cloth amount is detected again before entering a washing step S7, and the controller 57 may configure the setting of steps configuring step s7, by considering both of the dry cloth amount detected in the step S1 and the wet cloth amount detected in the step S5.

Specifically, the controller 57 may determine a final water supply level based on the dry cloth amount obtained in the step S1 and the wet cloth amount obtained in the step S5, and may control to perform additional water supply through the dispenser 31 and/or the spray nozzle 50, when the water level detected by the water level sensor 59 does not reach the final water supply level, after the rotation of the inner tub 5 is stopped in the step S5. Preferably, as in the embodiment, the first cold water valve 121 and the third cold water valve 123 are opened together, and the inner tub 5 is rotated at the first speed V1 while water is being supplied.

Thereafter, when the water level detected by the water level sensor 59 reaches the final water supply level, the water supply is stopped, and step S7 may be performed.

In the step S7, the inner tub 5 and/or the pulsator 15 are rotated according to a preset algorithm to perform washing. At this time, the algorithm may be set based on the cloth amount detected in the step S1 and/or S5.

FIG. 7 is a table showing steps according to a control method of another embodiment of the present invention. Referring to FIG. 7, in the control method of a washing machine according to another embodiment of the present invention, since the cold/hot water supply step S3 (see FIGS. 5 and 6) and the cloth wetting step S4 in the above embodiment are omitted and other configurations are substantially the same, the same configuration is based on the foregoing description. This control method is suitable for a washing machine used in an environment in which hot water is not supplied.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

The invention claimed is:

1. A method of controlling a washing machine comprising an outer tub containing water, an inner tub which accommodates laundry and is rotatably installed in the outer tub, a dispenser which supplies detergent into the inner tub, and a spray nozzle for spraying water into the inner tub, the method comprising the steps of:

(a) detecting a dry cloth amount;

(b) supplying water into the inner tub via the dispenser, and rotating the inner tub at a cloth dispersion speed set within a range in which at least some of the cloth can be shifted in the inner tub;

(c) supplying water into the inner tub through the spray nozzle, during when water is supplied into the inner tub via the dispenser;

(d) rotating the inner tub at a cloth wetting speed at which at least some of the laundry in the inner tub is adhered to an inner surface of the inner tub and can be rotated integrally with the inner tub, during when water is supplied through the spray nozzle, wherein the cloth wetting speed is accelerated from the cloth dispersion speed during when water is supplied through the spray nozzle;

(e) detecting a wet cloth amount and determining a final water supply level by rotating the inner tub at a preset speed after the step (d); and (f) supplying additional water to the final water supply level, wherein the cloth dispersion speed is determined based on the dry cloth amount, and the final water supply level is determined based on the dry cloth amount and the wet cloth amount.

2. The method of claim 1, wherein the step (b) comprises the steps of:

(b-1) supplying cold water together with the detergent into the inner tub by the dispenser; and (b-2) supplying hot water by the dispenser during when the cold water is supplied.

3. The method of claim 2, wherein the step (b-2) is performed after the step (b-1) is performed for a preset time.

4. The method of claim 2, wherein the water supply through the spray nozzle is performed for a preset time.

5. The method of claim 1, wherein the rotating of the inner tub at the cloth wetting speed is repeatedly performed until water level in the outer tub reaches a preset water level.

6. The method of claim 5, wherein the water supply through the dispenser is stopped, when the water level in the outer tub reaches the preset water level.

7. The method of claim 1, wherein, after the step (d), the water supply through the spray nozzle is stopped, and when a water level in the outer tub reaches a preset water level, the supply of water through the dispenser is stopped.

8. The method of claim 1, wherein the cloth wetting speed ranges from 80 to 120 rpm.

9. The method of claim 1, wherein the step (b) is stopped after a water level in the outer tub reaches a preset water level.

10. The method of claim 1, wherein the water supply is terminated when the water level in the outer tub reaches the final water supply level.

11. The method of claim 1, wherein the step (d) comprises a step of rotating the inner tub at the cloth dispersion speed during when the water is supplied through the spray nozzle.

12. The method of claim 11, wherein the step (d) alternately repeats a step of rotating the inner tub at the cloth wetting speed and a step of rotating the inner tub at the cloth dispersion speed.

* * * * *